US006643965B2

(12) United States Patent
Toraby-Payhan

(10) Patent No.: US 6,643,965 B2
(45) Date of Patent: Nov. 11, 2003

(54) MAGNETIC ALPHANUMERIC DISPLAY SYSTEM

(76) Inventor: Reza Toraby-Payhan, 1889 N. 105th East Ave., Tulsa, OK (US) 74116

( * ) Notice: Subject to any disclaimer, the term of this patent is extended or adjusted under 35 U.S.C. 154(b) by 0 days.

(21) Appl. No.: 10/145,584

(22) Filed: May 14, 2002

(65) Prior Publication Data

US 2002/0189145 A1 Dec. 19, 2002

Related U.S. Application Data

(60) Provisional application No. 60/290,726, filed on May 14, 2001.

(51) Int. Cl.[7] ..... G09F 7/04

(52) U.S. Cl. ..... 40/600; 40/621; 40/622; 40/450

(58) Field of Search ..... 40/621, 600, 450, 40/620, 622

(56) References Cited

U.S. PATENT DOCUMENTS

| | | | | | |
|---|---|---|---|---|---|
| RE13,525 | E | * | 2/1913 | De Puy | 40/620 |
| 2,642,686 | A | * | 6/1953 | Simpson | 40/622 |
| 3,225,477 | A | * | 12/1965 | Edwards | 40/620 |
| 4,220,948 | A | * | 9/1980 | Trame | 40/446 |
| 4,265,041 | A | * | 5/1981 | Edwards | 40/620 |
| 4,539,768 | A | * | 9/1985 | Halliday | 40/447 |
| 4,729,184 | A | * | 3/1988 | Cihanek | 40/450 |
| 5,065,537 | A | * | 11/1991 | Bailey | 40/621 |
| 5,428,914 | A | * | 7/1995 | Whitehouse et al. | 40/621 |

* cited by examiner

*Primary Examiner*—Gary Hoge
(74) *Attorney, Agent, or Firm*—Fellers, Snider, Blankenship, Bailey & Tippens, P.C.

(57) ABSTRACT

A display system for displaying display members such as numbers, letter or other indicia, e.g., for use in signage for displaying the price of gasoline on the premises of a service station. The display system of the invention utilizes magnets to facilitate easy substitution of display elements. The display system has a support surface supporting at least one securing member, which is preferably a V-shaped member having an upwardly facing recess. A magnet is provided proximate the securing member. A display member is provided with at least one secured member, e.g., an inverted isosceles triangle having a downwardly facing apex for complementary engagement with said upwardly facing recess of the securing member. A metallic mass is located proximate to the secured member for magnetic engagement with the magnet proximate the securing member. An extendable arm is preferably provided for manipulating the display members when the display members are mounted high off of the ground. Although the securing member is discussed as being located on the support surface, it should be understood that secured member may located on the support surface and vice versa. Similarly, the locations of the metallic mass and magnetic mass may be switched and still fall within the contemplated scope of the invention.

17 Claims, 4 Drawing Sheets

MAGNETIC ALPHANUMERIC DISPLAY SYSTEM

CROSS REFERENCE TO RELATED APPLICATION

This application claims the benefit of U.S. provisional application serial No. 60/290,726, filed on May 14, 2001, the disclosure of which is incorporated herein by reference.

BACKGROUND OF THE INVENTION

1. Field of the Invention

This invention relates to systems containing numbers, letters or other indicia for display, and, more specifically, to a magnetic display system affording easy substitution of alphanumeric display elements.

2. Background

Information about a wide range of products and services are often displayed on signs or billboards. It is often necessary to change the information displayed due to competitive factors, seasonal considerations, special promotions or for numerous other reasons.

Motor fuel, such as gasoline, is typical of a product for which information, such as pricing, changes frequently. The price of gasoline is typically advertised to the consumer by signage located on the premises of a service station. The signs are usually close to the road, and thus remote from the office or payment booth. They are typically elevated to increase their visibility to passing motorists. Such signs may be lighted for the same reasons, as well as to emphasize brand names and other consumer information. All of these factors raise problems with respect to changing the displayed information.

Display systems wherein numbers and letters are provided on individual tiles or placards have been in use for decades. Substitutions are made by replacing one tile having a first alphanumeric character with another having a second alphanumeric character.

Most popular currently is a system which uses flat screened plastic tiles that slide into parallel tracks affixed to a surface. Tiles are manipulated by an extendable arm having a suction cup at the end thereof which is pressed against the flat surface of the tile to create a suction grip.

A less popular system uses injection molded or thermoformed alphanumeric characters having two rows of parallel hooks on the back of the characters. The characters are manipulated by an extension arm having a contractible jaw that is managed by squeezing a lever at the end of the extension arm. The characters are grasped with the jaw, then hooked on parallel tracks affixed to a flat support surface.

The first described system is very problematic because once the tiles are in the tracks, removing them for the purpose of substitution is very difficult. The operator has to hit the tile face with the suction cup, which is usually eight or more feet away from the operator's hands. This action requires great force so that a suction grip is achieved. The chance of achieving good suction decreases as a tile face gets older, rougher and scratched, and as the rubber end of the suction cup hardens with age and becomes less flexible. Maintenance of such systems is costly.

The second described system is no less difficult. The hooks on the back of the characters must be solidly pushed onto the tracks for positive engagement therewith to avoid being knocked off by the wind when used in an outdoor display. This system is very operator unfriendly if one does not have the use of a step ladder or walkboard.

In both systems, the tracks on which the tiles or characters rest cause discoloration and shadows on the face of the sign, lessening the attractiveness of particularly back lighted signs. A large inventory of tiles or characters must be maintained, and, as it becomes necessary or desirable to change information, the inability to conveniently change the information creates serious service problems.

It is therefore an object of the present invention to provide an improved display system in which information displayed can be easily and conveniently changed.

Another object of the present invention is to provide an improved alphanumeric display system that permits convenient installation of same on the face of the signage.

SUMMARY OF THE INVENTION

The present invention is based upon my discovery that a system providing easy substitution of tiles and/or alphanumeric characters can be achieved using a zero force insertion multi-piece magnetic arrangement. The inventive magnetic display system can be used in connection with printed tiles or placards, shaped alphanumeric characters, or, indeed, with any type of rigid display member (hereinafter all of the above collectively referred to as a "display member") which is to be affixed to a support surface.

In the preferred system, a first securing member is mounted to the back of the display member. The first securing member is generally triangular in shape, having an apex that functions as a male connecting element, and possesses a metallic insert, preferably centered above the apex. The second securing member is mounted to the support surface and comprises a V-shaped female connecting element. The second securing member is sized and shaped to accept, in the crotch thereof, the first securing member and to hold the apex of the first securing member. A magnet is mounted in the support surface at a point corresponding to the crotch of the second securing member so that a magnetic attraction is provided between the first securing member and the support surface upon the mating of the first and second securing members.

There may be further provided in the display member one or more small metallic masses for the purpose of facilitating manipulation and changing of the display member by a telescopic arm having one or more rare earth magnets at the end thereof. The display member can be picked up by holding a magnetic head against the surface of the display member in the area of the hidden magnetic metal mass. A strong attraction creates a strong and positive grip so that the display member can be easily lifted and positioned onto the support surface.

The V-shaped second securing member along with the preferably flush-mounted magnet in the support surface guide the first securing member into place. The magnetic attraction between the first securing member and the support surface keeps the display member centered and prevents its upward movement by strong wind. The male and female connecting elements also serve as centering devices and prevent vibrational disengagement of the display member from the support surface.

A better understanding of the present invention, its several aspects, and its advantages will become apparent to those skilled in the art from the following detailed description, taken in conjunction with the attached drawings, wherein there is shown and described the preferred embodiment of the invention, simply by way of illustration of the best mode contemplated for carrying out the invention.

DETAILED DESCRIPTION OF THE INVENTION

Before explaining the present invention in detail, it is important to understand that the invention is not limited in its application to the details of the embodiments and steps described herein. The invention is capable of other embodiments and of being practiced or carried out in a variety of ways. It is to be understood that the phraseology and terminology employed herein is for the purpose of description and not of limitation.

Figure 1:
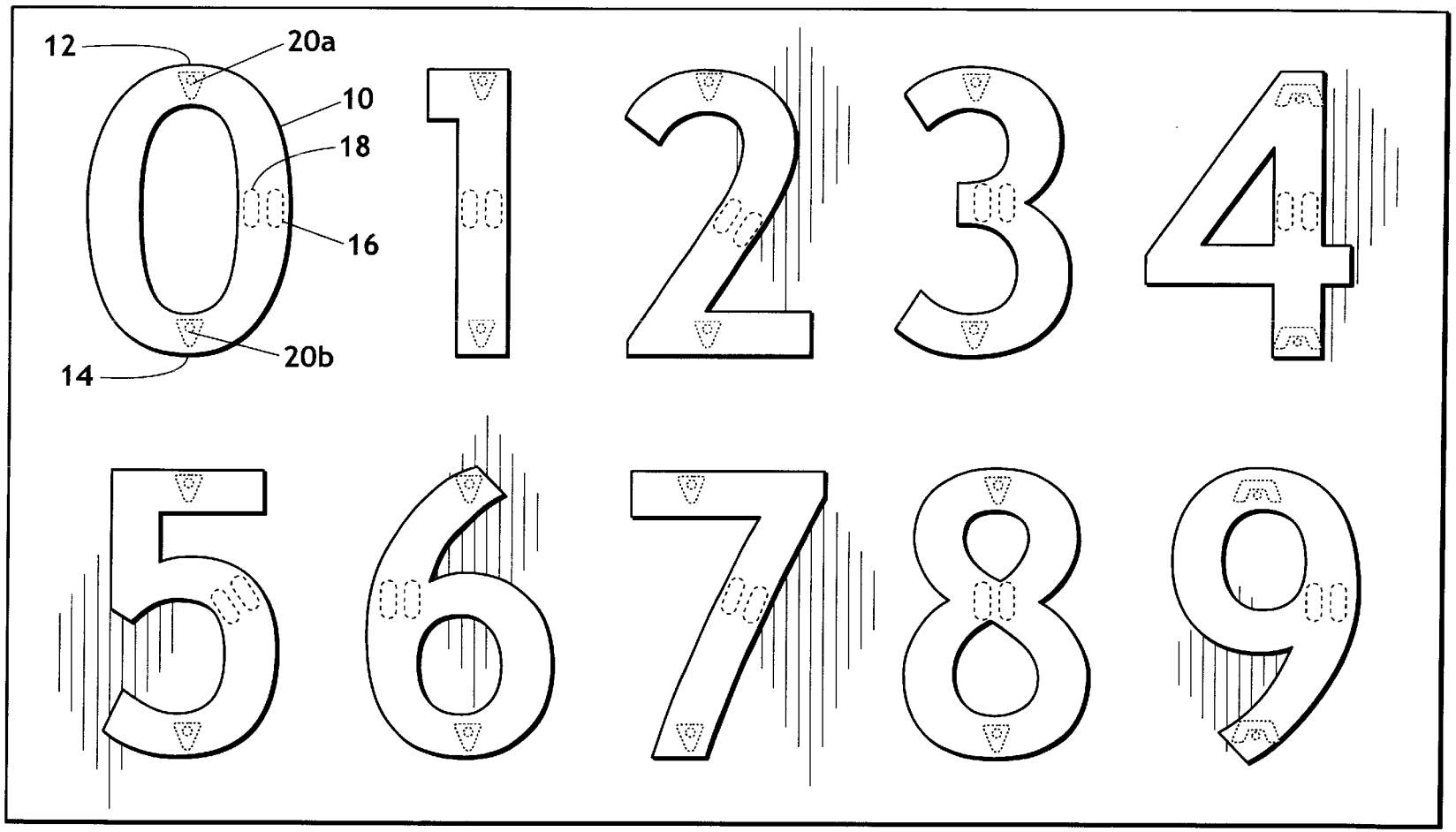
FIG. 1 is a view of a set of alphanumeric characters having the securing and handling mechanisms thereon.
Figure 2B:
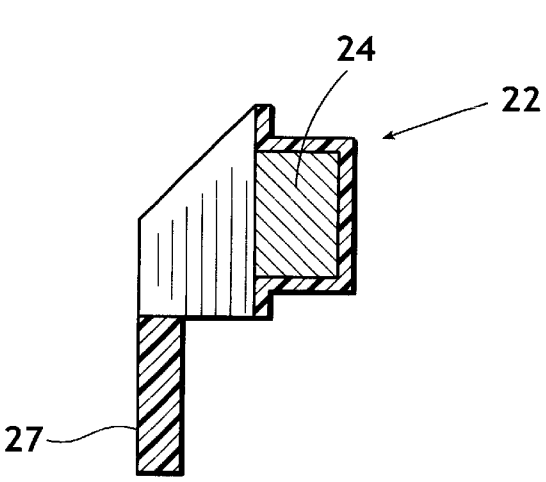
FIGS. 2A–D is a detailed schematic of the preferred embodiments of the first and second securing members.
Figure 2C:
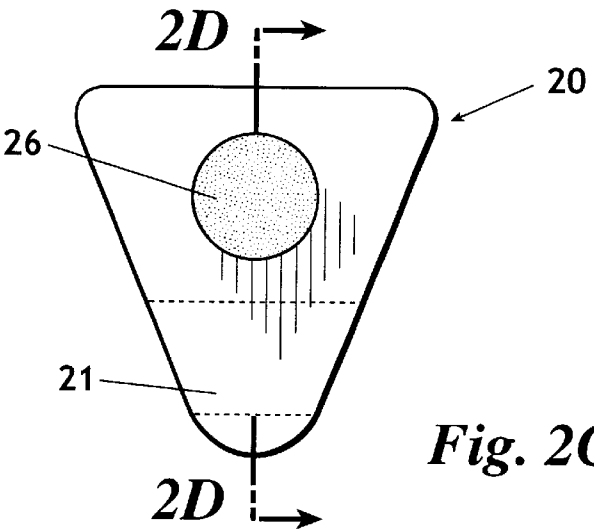
Figure 2A:
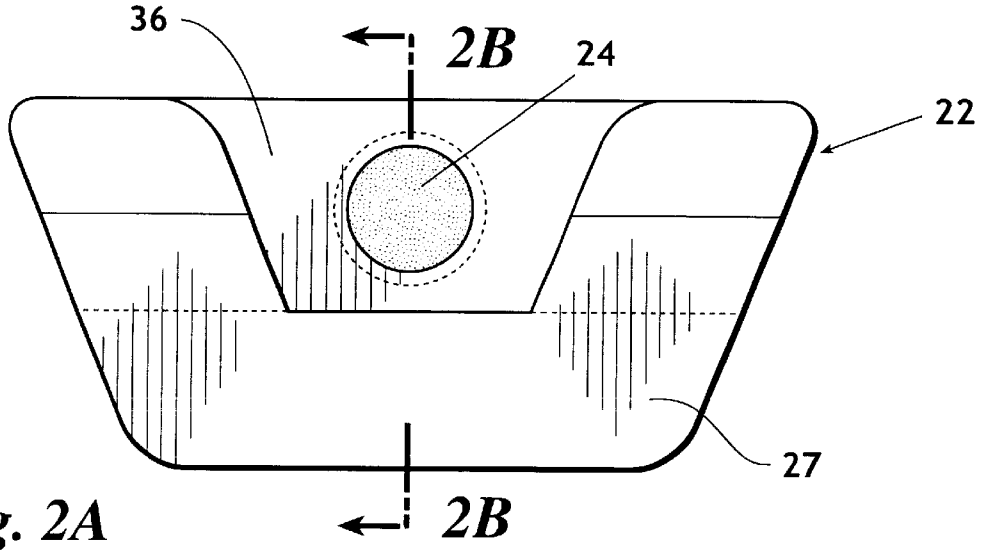
Figure 2D:
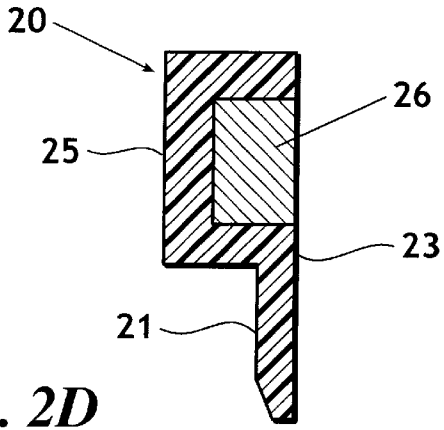
Figure 3:
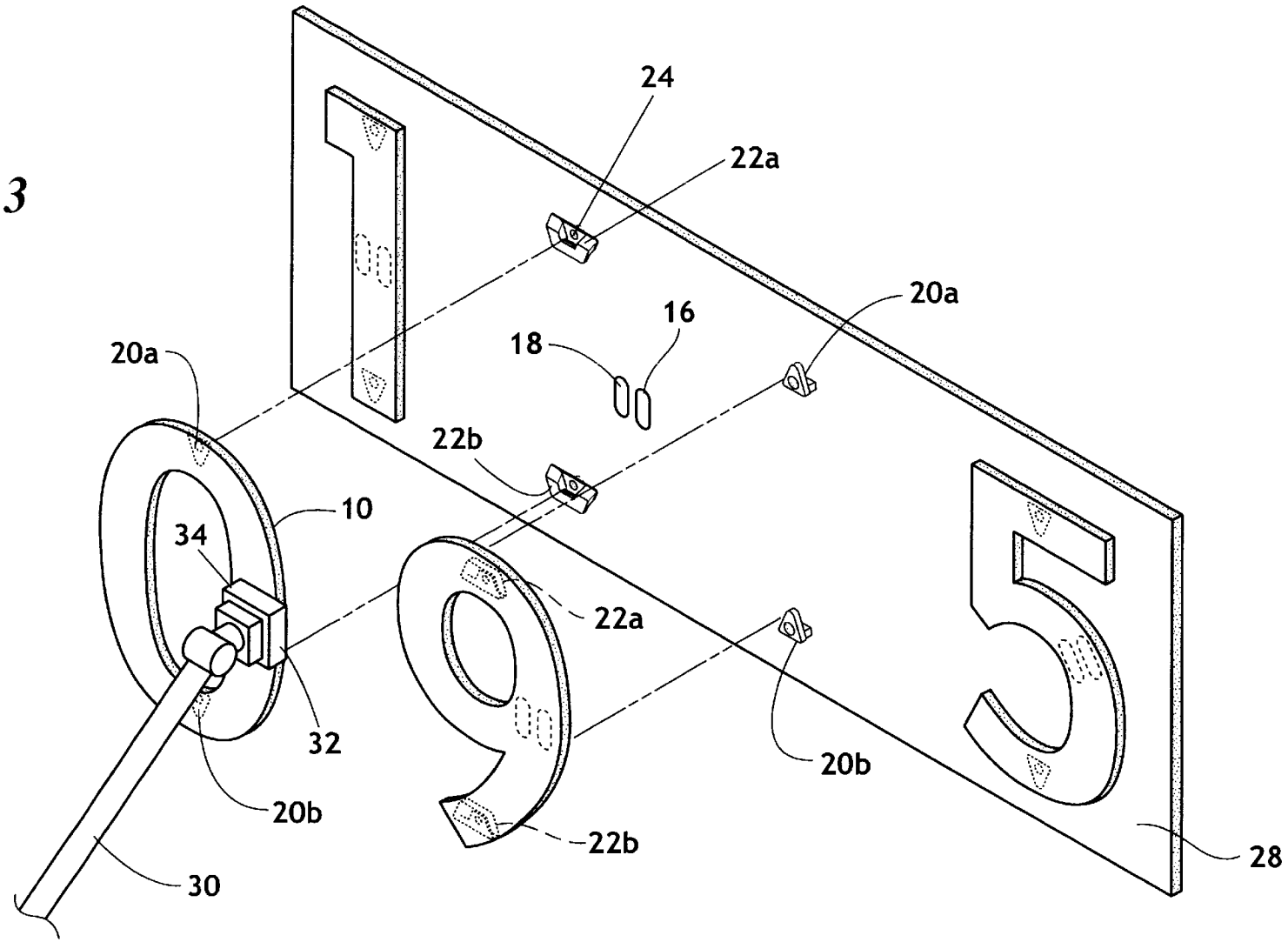
FIG. 3 demonstrates an installation according to the preferred embodiment of the present invention.

Referring now to the drawings, FIG. 1 shows a set of display members in the form of alphanumeric characters outfitted in accordance with the invention. Each such display member 10 has one or more of a first securing member 20 attached on the back thereof, generally adjacent to but slightly below the upper edge 12 of the display member 10. If two of the first securing members are utilized, it is preferred that the second of said first securing members (shown as element 20*b* of FIG. 1) be attached to the back of the display member 10 at the lower end 14 thereof directly underneath the other of said first securing members. Additionally affixed to the back of display member 10 are two small metal masses 16 and 18 which are spaced slightly apart from each other. The metal masses 16 and 18 are generally positioned between the upper end 12 and the lower end 14 of the display member 10 so as to permit the display member 10 to be manipulated and changed by a telescopic arm as shown in FIG. 3. Such metal masses can be of any shape, but presently preferred is their being in an elongated or circular form. While FIG. 1 shows the inventive system on a series of numerals, the securing system can be used in association with letters or any other rigid type plate members where it is desired to mount display members on a support surface.

As shown in FIG. 2, the first securing member 20 has a generally triangular shape so configured as to be received and secured by a second securing member 22. The first securing member 20 is preferably in the form of an inverted isosceles triangle having an apex 21, and, as shown in FIG. 2D, having a profile in the general shape of a question mark, whereby there is provided a flush outer surface 23 (for positioning adjacent the support surface) and an inner mounting surface 25 (for positioning adjacent the display member). The second securing member 22 is for mounting to the support surface and comprises a V-shaped female connecting element having an outwardly protruding horizontal catch 27 formed as a part thereof. At the area where the second securing member 22 is mounted at a predetermined location on a support surface, there is further provided a magnetic mass 24 inserted flush into the support surface. Such a magnet 24 serves to keep the display member centered and prevents upward movement of the display member once positioned therein. The first securing member 20 has a circular metallic mass 26 in the crook thereof and serves in cooperation with the magnet 24 located in the support surface to secure the display. As an alternative system, the first securing member 20 may have a magnetic mass in the center of same and the corresponding metallic mass or metal disc may be mounted on or in the support surface.

As shown in FIG. 3, in placing the display members 10 on a support surface 28, the V-shaped second securing members 22*a* and 22*b* are prelocated on the support surface at points which are so located as to accommodate the first securing members 20*a* and 20*b* located on the display member 10. A telescopic change arm 30 having two strong magnets 32 and 34 at one end thereof is moved into contact with the metallic masses (shown in phantom at 16 and 18) positioned on the back of the display member 10 so as to create a strong and positive grip, thereby permitting the display member 10 to be readily lifted and positioned on the support surface 28. Once positioned with the first securing member 20 being seated within the V-shaped crotch 36 (see FIG. 2A) of the second securing member 22, the telescopic arm 30 can be rotated so as to break the existing magnetic attraction, to be then retracted from the face of the display member 10. Presently it is desirable to have a gummy surface on the face of the magnets 32 and 34 so as to assist in stabilizing the display members 10 when being moved and to further assist in the removing of the magnetic mass from the display member once in place. When change of the display is desired, the foregoing procedure is reversed and once the magnets of the arm 30 are brought into contact with the face of the display member 10 in the area of the metallic masses 16 and 18, the display member 10 is readily lifted upward and the securing members 20 and 22 are thus disengaged.

In utilizing the present invention, the securing members 20 and 22 can be secured to the display member and the support surface by any conventional means which will effect the desired bonding. Thus, waterproof glues or other types of bonding agents can be employed.

Figure 4A:
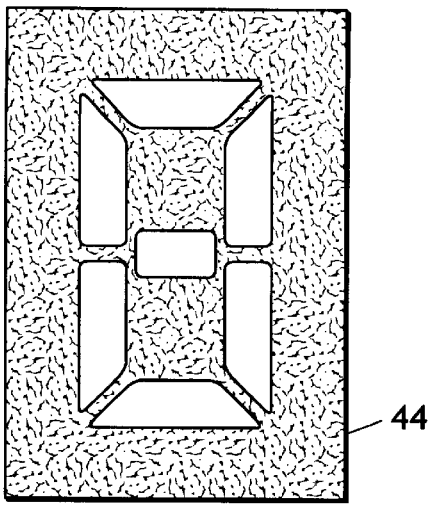
FIGS. 4A–F show a unique display member also possessing the inventive magnetic display system.
Figure 4B:
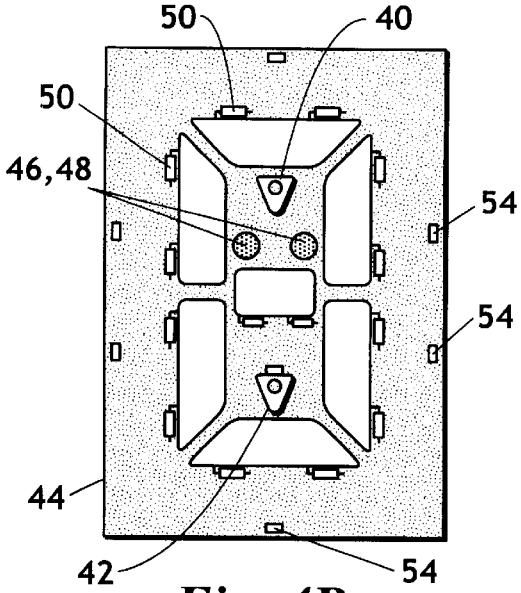
Figure 4C:
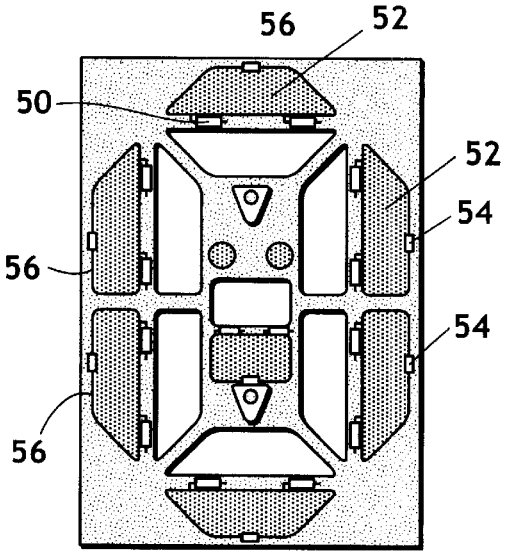
Figure 4D:
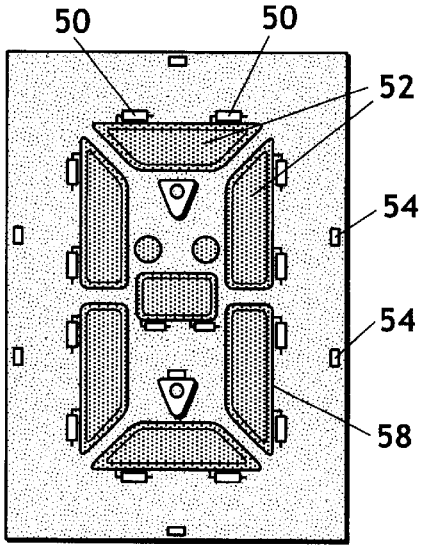
Figure 4E:
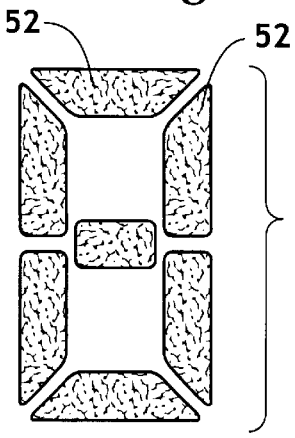
Figure 4F:
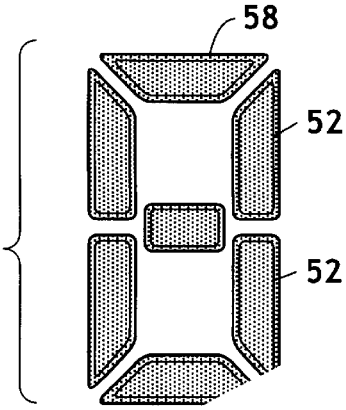

As shown in FIGS. 4A, 4B and 4D which represent a further embodiment of the present invention, two of the aforedescribed first securing members 40 and 42 are shown applied to the back of a display member 44 at an upper and lower area thereof whereby the securing members 40 and 42 are in a parallel position. Metal contact plates 46 and 48 are applied to the back of display member 44 below uppermost first securing member 40 and serve to permit installation or removal of the display member 44 when contacted with a telescopic dual magnetic head change arm as shown in FIG. 3. For convenience appropriate clip means can be provided on display member 44 to permit such metal contact plates 46 and 48 to be snapped into position. A series of hinges 50 are provided on the back of the display member 44 and are so located as to receive appropriate leaflets 52 as shown in FIG. 4C so as to permit the opening and closing of each of the leaflets 52 as may be desired to form an appropriate number when looking at the front of the display member 44, as illustrated by FIG. 4A wherein all seven leaflets are in an open position thereby forming the numeral 8.

As shown in FIG. 4B, there is provided a background display from which the numerals contrast. Each numeral comprises seven discreet segments which are arranged to form all of the numerals 0 through 9.

Further provided on the back of display member 44 is a series of leaflet clips 54 which are so positioned as to receive a leaflet edge 56 when in an open position to effect the securing of the leaflets 52. Likewise a series of leaflet clips 54 are so located as to receive the appropriate leaflet in a closed position.

The face of each of the leaflets 52 is such that when in a closed position, it will correspond to the front of the display member 44, thus permitting only an appropriate numeric value to be observed by means of the open leaflets. Each leaflet 52 is further provided with a rim 58 which serves to preclude leakage of light when in a closed position, thus permitting back lighting illumination of the back of display member 44 to effect the desired numerical value as formed by the open leaflets.

Through the use of a display member embodying this aspect of the invention there is achieved a readily changeable display which is conveniently positioned for viewing on an appropriate display surface.

While the invention has been described with a certain degree of particularity, it is understood that the invention is not limited to the embodiment(s) set for herein for purposes of exemplification, but is to be limited only by the scope of any allowed claim or claims, including the full range of equivalency to which each element thereof is entitled.

What is claimed is:

1. A display system comprising:

a support surface having a front face and a rear face;

at least one securing member on said front face of said support surface, said at least one securing member having one of an upwardly facing recess and an upwardly facing projection and is provided with one of a magnetic mass and a metallic mass;

a display member having a front face and a rear face;

at least one secured member on said rear face of said display member, said at least one secured member provided with one of a downwardly facing projection and a downwardly facing recess for complementary engagement with said one of an upwardly facing recess and an upwardly facing projection of said at least one securing member, said at least one secured member provided with one of a magnetic mass and a metallic mass for magnetic attraction to said one of a magnetic mass and a metallic mass of said at least one securing member.

2. The display system according to claim 1 wherein:

said at least one securing member on said front face of said support surface is V-shaped and has an upwardly facing recess; and said at least one secured member on said rear face of said display member is V-shaped and has a downwardly projecting apex for locating in said upwardly facing recess of said at least one securing member.

3. The display system according to claim 2 wherein:

wherein said at least one V-shaped securing member has a catch protruding outwardly from said front face of said support surface, said catch for receiving said downwardly facing projection of said V-shaped secured member on said rear face of said display member; and whereby, when said at least one V-shaped securing member and said at least one V-shaped secured member are engaged, one of said magnetic mass and said metallic mass of said V-shaped securing member is brought into magnetic mating relationship with said one of said magnetic mass and said metallic mass of said V-shaped secured member.

4. The display system according to claim 1 wherein:

said at least one securing member comprises an upper securing member and a lower securing member; and said at least one secured member comprises an upper secured member and a lower secured member.

5. The display system according to claim 1 further comprising:

an arm used to manipulate said display member, said arm having a magnet on a distal end thereof;

a metallic mass on said rear face of said support surface adapted to engage said magnet on said distal end of said arm for providing a magnetic "target" for assisting a user in locating said display member in a desired location.

6. The display system according to claim 1 further comprising:

an arm used to manipulate said display member; said arm having a distal end;

a gummy surface on said distal end of said arm for assisting in manipulating said display member.

7. The display system according to claim 1:

said display member is selected from a group of a symbol, a letter, and a numeral.

8. The display system according to claim 1:

wherein said display member is provided with a plurality of selectively movable leaflets for creating a desired image on said display member.

9. The display system according to claim 1 wherein:

said at least one secured member on said rear face of said display member are in the form of an inverted isosceles triangle; and wherein said downwardly facing projection is an apex of said inverted isosceles triangle.

10. A display system comprising:

a support surface having a front face and a rear face;

at least one securing member on said front face of said support surface, said at least one securing member having an upwardly facing recess and is provided with one of a magnetic mass and a metallic mass;

a display member having a front face and a rear face;

at least one secured member on said rear face of said display member, said at least one secured member provided with a downwardly facing projection for complementary engagement with said upwardly facing recess, said at least one secured member provided with one of a magnetic mass and a metallic mass for magnetic attraction to said one of a magnetic mass and a metallic mass of said at least one securing member.

11. The display system according to claim 10 wherein:

wherein said at least one securing member has a catch protruding outwardly from said front face of said support surface, said catch for receiving said downwardly facing projection of said secured member on said rear face of said display member; and whereby, when said at least one securing member and said at least one secured member are engaged, one of said magnetic mass and said metallic mass of said securing member is brought into magnetic mating relationship with said one of said magnetic mass and said metallic mass of said secured member.

12. The display system according to claim 10 wherein:

said at least one securing member comprises an upper securing member and a lower securing member; and said at least one secured member comprises an upper secured member and a lower secured member.

13. The display system according to claim 10 further comprising:

an arm used to manipulate said display member, said arm having a magnet on a distal end thereof;

a metallic mass on said rear face of said support surface adapted to engage said magnet on said distal end of said arm for providing a magnetic "target" for assisting a user in locating said display member in a desired location.

14. The display system according to claim 10 further comprising:

an arm used to manipulate said display member, said arm having a distal end;

a gummy surface on said distal end of said arm for assisting in manipulating said display member.

15. The display system according to claim 10:

said display member is selected from a group of a symbol, a letter, and a numeral.

16. The display system according to claim 10:

wherein said display member is provided with a plurality of selectively movable leaflets for creating a desired image on said display member.

17. The display system according to claim 10 wherein:

said at least one secured member on said rear face of said display member are in the form of an inverted isosceles triangle; and wherein said downwardly facing projection is an apex of said inverted isosceles triangle.

* * * * *